United States Patent [19]

Watson

[11] 4,376,685

[45] Mar. 15, 1983

[54] ACID COPPER ELECTROPLATING BATHS CONTAINING BRIGHTENING AND LEVELING ADDITIVES

[75] Inventor: Angus Watson, Bricktown, N.J.

[73] Assignee: M&T Chemicals Inc., Woodbridge, N.J.

[21] Appl. No.: 277,057

[22] Filed: Jun. 24, 1981

[51] Int. Cl.[3] ..... C25D 3/38

[52] U.S. Cl. ..... 204/52 R

[58] Field of Search ..... 204/52 R, 44, 106, 123

[56] References Cited

U.S. PATENT DOCUMENTS

| | | | |
|---|---|---|---|
| Re. 24,582 | 12/1958 | Rinker | 204/43 G |
| 2,272,489 | 2/1942 | Ulrich | 260/239 |
| 2,296,225 | 9/1942 | Ulrich | 260/239 |
| 2,355,070 | 8/1944 | Harford | 204/52 R |
| 2,391,289 | 12/1945 | Beaver | 204/52 R |
| 2,424,887 | 6/1947 | Henricks | 204/52 R |
| 2,462,870 | 3/1949 | Keller | 204/52 R |
| 2,563,360 | 8/1951 | Phillips et al. | 204/52 R |
| 2,609,339 | 9/1952 | Passal | 204/52 Y |
| 2,660,554 | 11/1953 | Ostrow | 204/43 G |
| 2,663,684 | 12/1953 | Pierce | 204/52 R |
| 2,700,019 | 1/1955 | Jernstedt et al. | 204/52 R |
| 2,700,020 | 1/1955 | Pierce | 204/52 R |
| 2,707,166 | 4/1955 | Brown et al. | 204/52 R |
| 2,707,167 | 4/1955 | Hoover | 204/52 R |
| 2,733,198 | 1/1956 | Ostrow et al. | 204/52 R |
| 2,737,485 | 3/1956 | Overcash et al. | 204/52 Y |
| 2,738,318 | 3/1956 | Fellowe et al. | 204/52 R |
| 2,758,076 | 8/1956 | Passal | 204/52 R |
| 2,773,022 | 12/1956 | Turner | 204/52 Y |
| 2,799,634 | 6/1957 | Woehrle et al. | 204/52 R |
| 2,805,193 | 9/1957 | Beaver | 204/52 R |
| 2,805,194 | 9/1957 | Beaver et al. | 204/52 R |
| 2,830,014 | 4/1958 | Gündel et al. | 204/49 |
| 2,837,472 | 6/1958 | Gündel | 294/49 |
| 2,842,488 | 6/1958 | Strauss et al. | 204/52 R |
| 2,848,394 | 8/1958 | Foulke et al. | 204/52 Y |
| 2,849,351 | 8/1958 | Gündel et al. | 204/44 |
| 2,849,352 | 8/1958 | Kirstahler et al. | 204/44 |
| 2,853,444 | 9/1958 | Pye et al. | 204/108 |
| 2,882,209 | 4/1959 | Brown et al. | 204/52 R |
| 2,910,413 | 10/1959 | Strauss et al. | 204/44 |
| 2,931,760 | 4/1960 | Westbrook | 204/52 R |
| 2,950,235 | 8/1960 | Strauss et al. | 204/52 R |
| 2,954,331 | 9/1960 | Abbott | 204/52 R |
| 2,967,135 | 1/1961 | Ostrow | 204/43 G |
| 2,986,498 | 5/1961 | Strauss et al. | 204/46 |
| 2,999,767 | 9/1961 | Clay et al. | 117/109 |
| 3,000,800 | 9/1961 | Strauss et al. | 204/52 R |
| 3,018,232 | 1/1962 | Bishoff et al. | 204/44 |
| 3,021,266 | 2/1962 | Ostrow et al. | 204/44 |
| 3,023,150 | 2/1962 | Willmund et al. | 204/44 |
| 3,030,282 | 4/1962 | Passal | 204/52 Y |
| 3,037,918 | 6/1962 | Ostrow et al. | 204/52 Y |
| 3,051,634 | 8/1962 | Strauss et al. | 204/52 R |
| 3,075,899 | 1/1963 | Strauss et al. | 204/52 R |
| 3,081,240 | 3/1963 | Strauss et al. | 204/52 R |
| 3,122,549 | 2/1964 | Gündel | 260/268 |
| 3,153,653 | 11/1964 | Raasch | 260/306 |
| 3,179,578 | 4/1965 | Strauss | 204/52 |
| 3,203,878 | 8/1965 | Willmund et al. | 204/52 R |
| 3,227,638 | 1/1966 | Burnsin et al. | 204/50 Y |
| 3,257,294 | 6/1966 | Michael | 204/45 R |
| 3,267,010 | 8/1966 | Creutz et al. | 204/52 R |
| 3,276,979 | 10/1966 | Strauss et al. | 204/49 |
| 3,309,293 | 3/1967 | Ostrow et al. | 204/52 Y |
| 3,313,736 | 4/1967 | Dickson et al. | 252/321 |
| 3,328,273 | 6/1976 | Creutz et al. | 204/52 R |
| 3,359,297 | 12/1967 | Gündel | 260/455 |
| 3,393,135 | 6/1968 | Rosenberg | 204/55 Y |
| 3,400,059 | 9/1968 | Michael et al. | 204/52 R |
| 3,414,493 | 12/1968 | Nobel et al. | 204/52 R |
| 3,453,242 | 6/1969 | Schmitt | 260/77.5 |
| 3,460,977 | 8/1969 | Golben | 117/109 |
| 3,502,551 | 3/1970 | Todt et al. | 204/52 R |
| 3,542,655 | 11/1970 | Kardos et al. | 204/52 R |
| 3,617,451 | 11/1971 | Slominski et al. | 204/34 |
| 3,642,589 | 2/1972 | Nobel et al. | 204/44 |
| 3,650,915 | 3/1972 | Quimby et al. | 204/52 R |
| 3,682,788 | 8/1972 | Kardos et al. | 204/52 R |
| 3,725,220 | 4/1973 | Kessler et al. | 204/52 R |
| 3,743,584 | 6/1973 | Todt et al. | 204/52 R |
| 3,751,289 | 8/1973 | Arcilesi | 204/38 B X |
| 3,770,598 | 10/1973 | Creutz | 204/52 R |
| 3,772,167 | 11/1967 | Bharucha | 204/43 T |
| 3,791,388 | 3/1974 | Ostrow et al. | 204/52 R |
| 3,804,729 | 4/1974 | Kardos et al. | 204/52 R |
| 3,832,291 | 8/1974 | Arcilesi | 204/40 |
| 3,841,979 | 10/1974 | Arcilesi | 204/38 B |
| 3,859,297 | 1/1975 | Sullivan | 260/306.5 |
| 3,923,613 | 12/1975 | Immel | 204/52 R |
| 3,940,320 | 2/1976 | Kardos et al. | 204/52 R |
| 3,956,078 | 5/1976 | Kardos et al. | 204/52 R |
| 3,956,079 | 5/1976 | Kardos et al. | 204/52 R |
| 3,976,604 | 8/1976 | Roberts | 260/2 EN |
| 3,988,219 | 10/1976 | Rosenberg | 204/55 R |
| 4,007,098 | 2/1977 | Rosenberg | 204/55 R |
| 4,036,711 | 6/1977 | Kardos et al. | 204/52 R |
| 4,038,161 | 7/1977 | Eckles et al. | 204/52 R |
| 4,049,510 | 9/1977 | Rosenberg | 104/55 R |
| 4,100,040 | 7/1978 | Rosenberg | 204/55 R |
| 4,110,176 | 8/1978 | Creutz et al. | 204/52R |
| 4,134,802 | 1/1979 | Herr | 204/43 T |
| 4,134,803 | 1/1979 | Eckles et al. | 204/52 R |
| 4,181,582 | 1/1980 | Dahms | 204/52 R |
| 4,221,826 | 9/1980 | Baltrushaitis et al. | 427/96 |

FOREIGN PATENT DOCUMENTS

| | | | |
|---|---|---|---|
| 1151159 | 7/1963 | Fed. Rep. of Germany | 204/52 R |
| 1915653 | 12/1977 | Fed. Rep. of Germany | 204/55 R |
| 1515363 | 3/1968 | France | 204/52 R |

*Primary Examiner*—G. L. Kaplan

*Attorney, Agent, or Firm*—Stanley A. Marcus; Sheldon H. Parker; Franklyn Schoenberg

[57] ABSTRACT

The invention is concerned with the electrodeposition of copper from an aqueous acidic bath containing the following additives:

a. An alkylated polyalkyleneimine obtained as the reaction product of a polyalkyleneimine represented by the formula :

$$H_2N-(CH_2)_nNH-R$$

wherein R is H or $(CH_2)_n NH_2$ and n=1 to 6 with an epihalohydrin and an alkylating agent; an organic sulfo sulfonate; a polyether; and optionally a thioorganic compound.

45 Claims, No Drawings

ACID COPPER ELECTROPLATING BATHS CONTAINING BRIGHTENING AND LEVELING ADDITIVES

BACKGROUND OF THE INVENTION

This invention is concerned with the electrodeposition of copper from aqueous acidic baths. More particularly this invention is concerned with an aqueous acidic bath for the electrodeposition of copper containing additives which provide bright and leveled copper electrodeposits and to a process for electrodepositing copper employing said bath.

In the past a large number of agents have been described in the art for use in electroplating baths alone or in combination to improve the quality of the electrodeposit in terms of brightness, surface smoothness, hardening, leveling and to increase th lower limiting current density of deposition.

The present invention has as its object the formation of bright and leveled copper electrodeposits from an aqueous acidic bath, particularly an aqueous acidic sulfate bath by adding to such bath certain additives. The term "leveled" denotes a copper deposit whose surface is smoother than its substrate. The term "bright" indicates that the formed electrodeposit is characterized by having a uniform highly reflective surface gloss over most of its surface. Generally leveling and brightness vary with the current density at the cathode, all other factors such as copper salt concentration, pH, type of acid, temperature etc. being equal. As the current density decreases brightness of the electrodeposit tends to decrease often diminishing to a haze which may be unacceptable for many commercial applications. The strength of leveling also varies with current density.

The present invention provides bright copper electrodeposits over a wide current density range including low current densities on the order of 0.4 amps. sq. dm. or less with strong leveling properties throughout. The high degree and rate of leveling achieved according to the present invention translates to economy in the finishing costs of the electrodeposited substrate and in the materials necessary therefor. The improved low current density brightness, that is the widening of the bright current density range, according to the invention allows strongly profiled objects to be electroplated with substantially uniform brightness. The additives also prevent roughness formation at high current densities and increase hardness of the electrodeposit.

SUMMARY OF THE INVENTION

The additives of this invention comprise:

A. An alkylated polyalkyleneimine obtained as the product from the reaction of a short chain polyalkyleneimine containing from 2 to 3 amine nitrogen atoms and an alkylene group of from 1 to 6 carbon atoms between amine nitrogen atoms with an epihalohydrin which is then alkylated with an organic halide or an organic sulfonate.

B. An organic sulfo sulfonate compound of the formula:

$$R_1—(S)_n—RSO_3M$$

wherein M is an alkali metal or ammonium ion; n is from 1 to 6; R is an alkylene group of from 1 to 8 carbon atoms, a divalent aromatic hydrocarbon or an aliphatic-aromatic hydrocarbon containing 6 to 12 carbon atoms; $R_1$ is a group represented by the formula $MO_3SR$, wherein M & R are as described above;

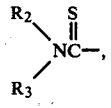

wherein $R_2$ & $R_3$ are each hydrogen or an alkyl group having from 1 to 4 carbon atoms,

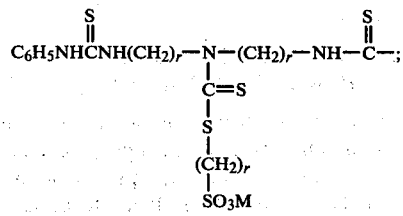

and

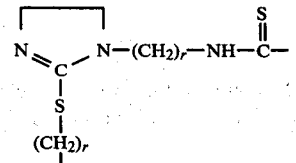

$SO_3M$, wherein r is from 2 to 6;

C. A polyether of the formula:

$$R(OZ)_m$$

wherein R is hydrogen, alkyl, alkenyl, alkynyl, alkylaryl, arylalkyl; m is 5 to 100; and $$Z=(C_uH_{2u}O)_r(C_vH_{2v}O)_sT$$

wherein u and v=0 to 4 but at least one of u or v must be greater than 0, r+s=6 to 200,000; r=0 when u=0; s=0 when v=0; and T is hydrogen, alkyl or benzyl.

D. A thioorganic compound of the structural formula:

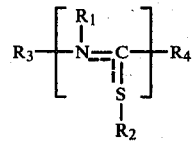

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one S, N or N-substituted group, $R_3$ is hydrogen, alkyl, aralkyl, and $R_4$ is

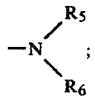

wherein $R_5$ and $R_6$ are each hydrogen, alkyl or aralkyl groups.

The combination of A, B & C above in a chloride-containing acid copper plating bath gives unexpected beneficial effects in brightness and leveling over the use of each additive alone. When D is also used in combination with A, B & C brightness and leveling is even further enhanced.

DETAILED DESCRIPTION OF THE PREFERRED EMBODIMENTS

The alkylated polyalkyleneimine additive of this invention is obtained by first reacting a polyalkyleneimine with an epihalohydrin, preferably epichlorohydrin, in about equal molar ratios. The polyalkyleneimine contains from 2 to 3 amine nitrogen atoms and an alkylene group of from 1 to 6 carbon atoms between amine nitrogen atoms and may be represented by the formula:

$$H_2N-(CH_2)_nNH-R$$

wherein R is H or $(CH_2)_n NH_2$ and n = 1 to 6. The maximum molecular weight of the polyalkyleneimine is about 215.

Typical polyalkyleneimines include ethylene diamine propylene diamine, diethylene triamine, dipropylene triamine and the like. The reaction product of the polyalkyleneimine and epihalohydrin is then neutralized with a base such as NaOH. To this product is added about an equimolar amount of an alkylating agent such as an alkyl halide having from 1 to 3 carbon atoms, an alkylene halide having from 3 to 6 carbon atoms, an alkynyl halide having from 3 to 6 carbon atoms, or an aralkyl halide such as benzyl chloride. An organic sulfonate such as propane sultone or a halopropyl sulfonate may also be used as the alkylating agent. Benzyl chloride is particularly preferred as the alkylating agent. There is no evidence of the formation of quaternary nitrogens by the alkylating agent.

The organic sulfo sulfonate additive of this invention contains the structural moieties $$-(S)_nRSO_3M \text{ or } -N-\overset{\overset{\displaystyle S}{\|}}{C}S-R-SO_3M$$

wherein R is a divalent hydrocarbon, M is an alkali metal or ammonium cation and n is a number greater than 1.

These organic sulfo sulfonates can be represented by the formula:

$$R_1-(S)_n-RSO_3M$$

wherein M is an alkali metal or ammonium ion; n is from 1 to 6; R is an alkylene group of from 1 to 8 carbon atoms, a divalent aromatic hydrocarbon or an aliphatic aromatic hydrocarbon of 6 to 12 carbon atoms; $R_1$ is a group represented by the formula $MO_3SR$, wherein M & R are as described above,

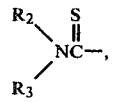

wherein $R_2$ & $R_3$ are each hydrogen or an alkyl group having from 1 to 4 carbon atoms,

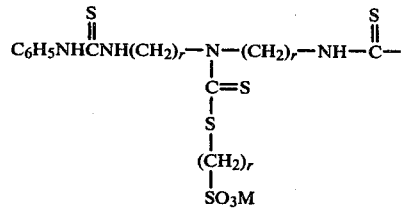

and

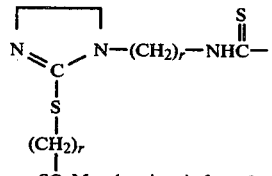

$SO_3M$, wherein r is from 2 to 6;

Typical organic sulfo sulfonates include compounds of the following classes:

(1) Disulfo sulfonates of the formula:

$$MO_3S(CH_2)_aS-S(CH_2)_aSO_3M$$

wherein a is from 2 to 6 and preferably each a is 3.

(2) Sulfonated dialkyl dithiocarbamates of the formula:

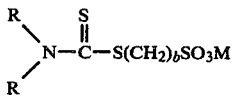

wherein R may be each an alkyl group of from 1 to 3 carbon atoms or a cycloaliphatic hydrocarbon and b is a number from 2 to 6.

(3) A disulfonated compound containing at least one thiourea radical and at least one dithiocarbamic acid radical which includes the disodium salt of 1-phenylthioureido-3,6-diazahexamethylene-3,6 bis-(dithiocarbamic acid propyl ester-w-sulfonic acid) of the formula:

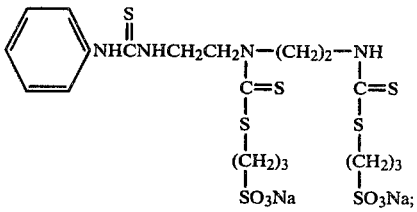

and the reaction product of the sodium salt of 2-thioimidazolinyl-N-ethyl dithiocarbamic acid propyl ester-w-sulfonic acid with propane sultone, said product having the formula:

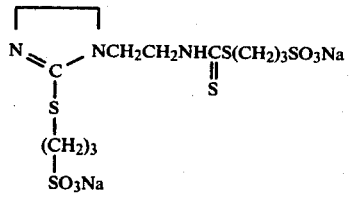

These compounds are described in U.S. Pat. No. 3,203,878.

The polyether additives of this invention are represented by the formula:

$$R(OZ)_m$$

wherein R is hydrogen, alkyl, alkenyl, alkynyl, alkylaryl, arylalkyl; m is 5 to 100; and $$Z=(C_uH_{2u}O)_r(C_vH_{2v}O)_sT$$

wherein u and v=0 to 4 but at least one of u or v must be greater than 0, r+s=6 to 200,000; r=0 when u=0; s=0 when r=0; and T is hydrogen, alkyl or benzyl.

Typical polyethers are listed in Table 1 below:

TABLE 1

1. $C_{15}H_{31}O(CH(CH_3)CH_2O)_y(CH_2CH_2O)_xH$
where x = 5–40 and y = 0–5

2. $C_{9-12}H_{19-25}O(CH_2CH_2O)_xH$
where x = 5–40

3. $CH_2(O(CH_2CH_2O)_xH)-(CH_2)_n-CH_2(O(CH_2CH_2O)_xH)$
where x = 5–40 and n = 5–10

4. $CH_2(O(CH_2CH_2O)_mH)CH(C_2H_5)-CH(O(CH_2CH_2O)_nH)-CH_2CH_2CH_3$
wherein m or n may each be 5–40

5. 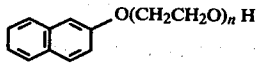
where n = 5–40

6. 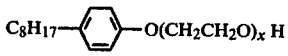
where x = 4–50

7. 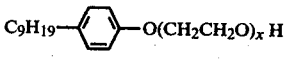
where x = 5–40

8. $HOCH_2CH_2O(-CH_2CH_2O)_xH$
where x = 5–4,000

9. 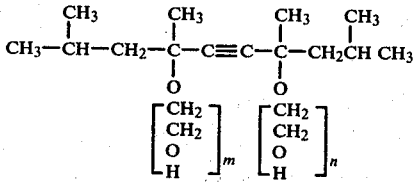
m + n = 10–30

TABLE 1-continued

10.

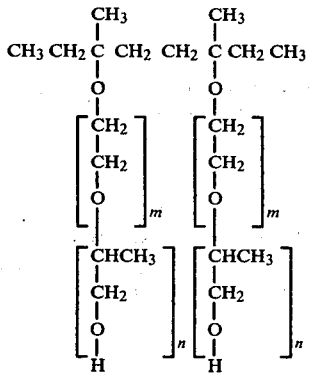

wherein m =0 about 12–15 and n = 1–2

11.

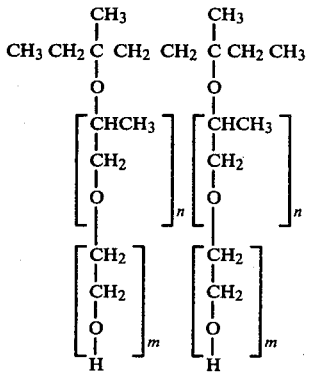

m about 12–15 n = 1–2

12. $HO(CH_2CH_2O)_a(\underset{\displaystyle CH_3}{\underset{|}{C}}HCH_2O)_b(CH_2CH_2O)_aH$ 13. $H(OCH_2\overset{\displaystyle CH_3}{\overset{|}{C}}H)_b(OCH_2CH_2)_aOCH_2CH_2O(CHCH_2O)_a(\overset{\displaystyle CH_3}{\overset{|}{C}}HCH_2O)_bH$ a = 6–50 b = 1–10

The thioorganic additives of this invention are those containing the structural formula:

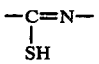

or its tautomeric form:

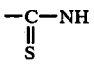

These tautomeric groups may be a part of a noncyclic molecule such as an open chain thiourea in which they become a part of the wider groups

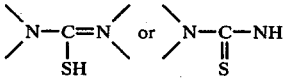

or they may be a part of a heterocyclic ring structure further containing carbon atoms or carbon atoms and one or more O, N or S atoms in which case they become part of the wider groups.

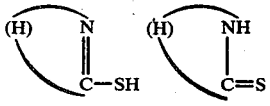

wherein (H) is a heterocyclic ring as described above.

The thioorganic compounds may also be contained in heterocyclic rings in non-tautomeric forms such as

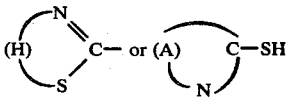

wherein (H) is as described above and (A) is an aromatic nucleus.

Generally the thioorganic compounds of this invention can be represented by the formula:

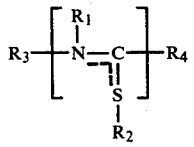

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one S, N or N-substituted atom, $R_3$ is hydrogen alkyl, aralkyl, and $R_4$ is

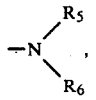

wherein $R_5$ and $R_6$ are each hydrogen, alkyl or aralkyl groups.

Typical examples of these compounds are: thiourea and N-alkyl and aryl-substituted thioureas such as dimethyl, diethyl and benzyl substituted thioureas, 2-thiazolidinethione 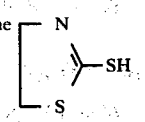

1-(2-hydroxyethyl) -2- imidazolidine thione 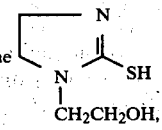

2-aminothiazole 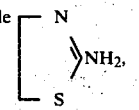

2-imidazolinethione, 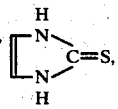

2-mercaptopyridine, 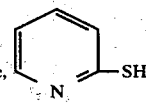

and benzothiazolethione 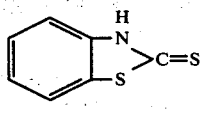

Particularly preferred is an equimolar mixture of 2-thiazolidinethione and 1-(2-hydroxyethyl)-2-imidazolidine thione.

The alkylated polyalkyleneimines in combination with the organic sulfo sulfonates, and polyethers in an acid copper electroplating bath give bright copper deposits over a wide current density range with strong leveling properties. The polysulfide containing organic sulfo sulfonates, that is where n=1 or more, have been found to be much more effective than the corresponding monosulfides.

When the thioorganic compound is additionally added to an acid copper bath leveling is maintained at very low current densities, i.e. on the order of 0.2 to 0.4 amp. sq. dm.

Generally the amount of alkylated polyalkyleneimine added to the acid copper plating bath should vary from 0.0001 to 0.1 g/l of bath and preferably from 0.001 to 0.05 g/l. The amount of organo sulfo sulfonate compound should be between 0.001 to 0.1 g/l and preferably from 0.010 to 0.050 g/l. The amount of polyether additive should be between 0.005 g/l and 10.0 g/l and preferably from 0.010 to 1.0 g/l. The amount of thioorganic compound should be between 0.0001 and 0.100 g/l and preferably from 0.001 to 0.050 g/l.

Typical aqueous acidic copper plating baths in which the additives of this invention may be contained include the following:

| COMPONENT | CONCENTRATION |
|---|---|
| Copper Sulfate ($CuSO_4.5H_2O$) | 150–300 g/l |
| Concentrated Sulfuric Acid | 10–110 g/l (ml) |
| Chloride ($Cl^-$) | 5–150 mg/l |

The additives of this invention may also be employed in acid copper fluoroborate baths.

In order to more completely describe the present invention, the following Examples are submitted.

In all Examples the bath contained the following components:

| | |
|---|---|
| $CuSO_4.5H_2O$ | 225 g/l |
| $H_2SO_4$ | 55 g/l |
| $Cl^-$ | 60 mg/l |

A standard 267 ml Hull Cell was employed in each Example using as the cathode a brass panel given a standard scratch with 0/4 emery paper and preplated with a copper strike and a copper anode. The current employed was 2 amperes for 10 minutes which gave a range of current densities of from about 0.1 amps./sq.dm. to 15.0 amps./sq.dm. across the cathode. All experiments were run at room temperature using air agitation.

EXAMPLE 1

In this Example the following additives were added to the acid copper bath prior to electrodeposition.

| | Additve | Concentration |
|---|---|---|
| 1. | Alkylated polyalkyleneimine (Reaction product of diethylene triamine, epichlorohydrin and benzyl chloride) | 0.0027 g |
| 2. | Organic sulfo sulfonate $(CH_3)_2N-\overset{\overset{\displaystyle S}{\|}}{C}-S(CH_2)_3SO_3Na$ | 0.015 g/l |
| 3. | Polyether (polyethylene glycol having an average molecular weight of 6000) | 0.060 g/l |

The alkylated polyalkyleneimine was prepared by combining 20.6 g of diethylene triamine (0.2 mole), with 91 ml water in a 250 ml round bottomed flask. To this combination was slowly added 18.5 g (0.2 mole) of epichlorohydrin at a rate sufficient to maintain the exothermic reaction temperature below about 130° F. After all the epichlorohydrin was added, the reaction mixture was refluxed 2 hrs. The reaction mixture was then cooled and 20 ml of 10 N NaOH (0.2 mole) was added to neutralize the solution. To this neutralized solution was added 25.5 g (0.2 mole) of benzyl chloride and refluxed for 4 hours. A straw-colored gum precipitated. After decanting off the aqueous layer the alkylated polyalkyleneimine residue was separated. There was no evidence of quaternary nitrogen formation.

The panels, after electrodeposition, were found to be fully bright and well leveled above 0.6 amp. sq. dm. To the same bath was added 0.006 g/l of 2-thiazolidinethione and 0.006 g/l of -1-(2-hydroxyethyl)-2-imidazolidine thione and the electrodeposition of the panel was repeated. The panel exhibited a bright, well leveled copper deposit over most of the Hull Cell current density range.

EXAMPLE 2

The following additives were added to the acid copper bath:

| | Additive | Concentration |
|---|---|---|
| 1. | Organic Sulfo Sulfonate $NaO_3S(CH_2)_3S—S(CH_2)_3SO_3Na$ | 0.20 g/l |
| 2. | Polyether (formed from the condensation of 15 moles ethylene oxide with a secondary alcohol containing 15 carbon atoms) | 0.06 g/l |

A bright copper deposit in the high current density range (greater than 4 amp. sq.dm. was obtained.)

To the acid copper bath containing the above additives was added 0.0034 g/l of an alkylated polyalkyleneimine obtained as the reaction product of substantially equal molar amounts of diethylene triamine, epichlorohydrin and propane sultone.

A bright and well-leveled copper deposit was obtained above about 0.4 amp. sq.dm.

To the acid copper bath containing the above described organo sulfo sulfonate, polyether and alkylated polyalkylene imine was added 0.001 g/l of a thioorganic compound, N-ethyl thiourea.

This addition increased the brightness of the panel as well as the bright current density range of deposition and produced strong leveling at current densities above about 0.2 amp. sq.dm.

Another thioorganic compound, 2-mercaptopyridine-N-oxide was added to the acid copper bath in place of N-ethyl thiourea. Substantially the same result was achieved as in the case of N-ethyl thiourea.

EXAMPLE 3

The following additives were added to the acid copper bath.

| | Additive | Concentration |
|---|---|---|
| 1. | Alkylated polyalkyleneimine (Reaction product of diethylene triamine, epichlorohydrin and 3-chloro-2-hydroxy propyl sulfonate) | 0.0036 g/l |
| 2. | Organic sulfo sulfonate $NaO_3S(CH_2)_3S—S(CH_2)_3SO_3Na$ | .0020 g/l |
| 3. | Polyether (Product of 10 moles propylene oxide with a condensate of 8 m ethylene oxide and ethylene glycol) | 0.060 g/l |

The resulting deposit was bright, ductile and had good leveling above about 0.8 amp. sq.dm.

EXAMPLE 4

In this Example two acid copper plating baths were prepared each containing an alkylated polyalkyleneimine comprising the reaction product of diethylene triamine, epichlorohydrin and benzyl chloride, an organo sulfo sulfonate and polyether according to the invention. To one bath was added 2-thiazolidinethione and to the other bath was added -1-(2-hydroxyethyl)-2-imidazolidine thione at concentrations of about 0.006 g/l. Two panels were electrodeposited with copper.

It was found that these baths produced bright and leveled copper deposits on the panels but that a bath containing both 2-thiazolidinethione and -1-(2-hydroxyethyl)-2-imidazolidine thione as in Example 1 gave superior results.

It was also found that equimolar concentrations of 2-thiazolidinethione and -1-(2-hydroxyethyl)-2-imidazolidine thione in an acid copper bath provide greater leveling and brightness than baths containing other than substantially equimolar concentrations of these additives.

EXAMPLE 5

In this example an alkylated polyalkyleneimine was prepared by reacting a polyethyleneimine having a molecular weight greater than about 215 with epichlorohydrin and benzylchloride. When tested for leveling properties in an acid copper bath it was less satisfactory than an alkylated polyalkyleneimine prepared by reacting a polyethyleneimine having a molecular weight no greater than about 215 with epichlorohydrin and benzyl chloride.

EXAMPLE 6

In this Example, a quaternary polyalkyleneimine was prepared by reacting a polyalkyleneimine having a molecular weight of about 600 with propylene oxide to form a propoxylated intermediate and then quaternerizing the intermediate with benzyl chloride using a 5 fold molar excess of benzyl chloride. This product when tested as a leveler in an acid copper bath exhibited good leveling properties but not as good as the leveling properties of Additive 1. Example 1 (non-quaternerized polyalkylenimine). The quaternerized polyalkyleneimine also gave a cloudy area on the plate at low current densities.

I claim:

1. An aqueous acid copper electroplating bath containing an alkylated polyalkyleneimine obtained as the reaction product of a polyalkyleneimine represented by the formula:

$$H_2N—(CH_2)_n NH—R$$

wherein R is H or $(CH_2)_n NH_2$ and n=1 to 6, with an epihalohydrin and an alkylating agent.

2. The acid copper bath of claim 1 wherein said polyalkyleneimine is selected from the group consisting of ethylene diamine, propylene diamine, diethylene triamine and dipropylene triamine.

3. The acid copper bath of claim 1 wherein said alkylating agent is selected from the group consisting of an alkyl halide having from 1 to 3 carbon atoms, an alkylene halide having from 3 to 6 carbon atoms, an alkynyl halide having from 3 to 6 carbon atoms, and an aralkyl halide.

4. The acid copper bath of claim 3 wherein said aralkyl halide is benzyl chloride.

5. The acid copper electroplating bath of claim 1 which further comprises an organic sulfo sulfonate represented by the formula:

$$R_1-(S)_n-RSO_3M$$

wherein M is an alkali metal or ammonium ion; n is from 1 to 6; R is selected from the group consisting of an alkylene group having from 1 to 8 carbon atoms, a divalent aromatic hydrocarbon and an aliphatic-aromatic hydrocarbon containing 6 to 12 carbon atoms; $R_1$ is selected from the group consisting of the group $MO_3SR$, where M & R are as described above,

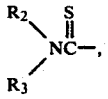

wherein $R_2$ & $R_3$ are each hydrogen or an alkyl group having from 1 to 4 carbon atoms,

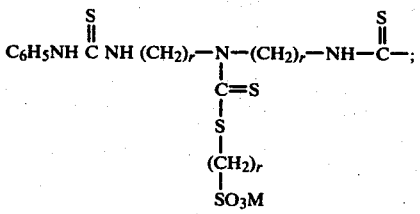

and

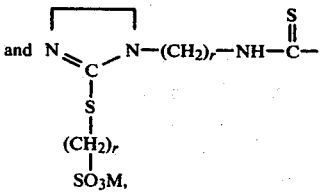

wherein r is from 2 to 6.

6. The acid copper electroplating bath of claim 1 which further comprises a polyether represented by the formula:

$$R(OZ)_m$$

wherein R is selected from the group consisting of hydrogen, alkyl, alkenyl, alkynyl, alkylaryl and arylalkyl; m is 5 to 100; and $$Z=(C_uH_{2u}O)_r(C_vH_{2v}O)_sT$$

wherein u and v=0 to 4 but at least one of u or v must be greater than 0, r+s=6 to 200,000; r=0 when u=0; s=0 when v=0; and T is selected from the group consisting of hydrogen, alkyl and benzyl.

7. The acid copper electroplating bath of claim 1 which further comprises a thioorganic compound represented by the formula:

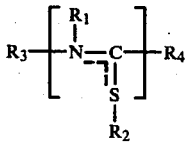

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one heteroatom selected from the group consisting of S, N and N-substituted atom, $R_3$ is selected from the group consisting of hydrogen, alkyl and aralkyl, and $R_4$ is

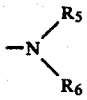

wherein $R_5$ and $R_6$ are each selected from the group consisting of hydrogen, alkyl and aralkyl groups.

8. The acid copper electroplating bath of claim 1 wherein said epihalohydrin is epichlorohydrin.

9. An aqueous acid copper electroplating bath containing a. An alkylated polyalkyleneimine obtained as the reaction product of a polyalkyleneimine represented by the formula:

$$H_2N-(CH_2)_nNH-R$$

wherein R is H or $(CH_2)_n NH_2$ and n=1 to 6 with an epihalohydrin and an alkylating agent;

b. An organic sulfo sulfonate represented by the formula:

$$R_1-(S)_n-RSO_3M$$

wherein M is an alkali metal or ammonium ion; n is from 1 to 6; R is selected from the group consisting of an alkylene group having from 1 to 8 carbon atoms, a divalent aromatic hydrocarbon and an aliphatic-aromatic hydrocarbon containing 6 to 12 carbon atoms; $R_1$ is selected from the group consisting of $MO_3SR$, wherein M & R are as described above,

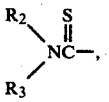

wherein $R_2$ & $R_3$ are each hydrogen or an alkyl group having from 1 to 4 carbon atoms,

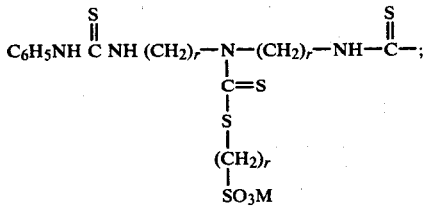

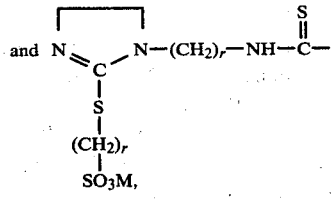

wherein r is from 2 to 6; and c. a polyether represented by the formula:

$R(OZ)_m$ wherein R is selected from the group consisting of hydrogen, alkyl, alkenyl, alkynyl, alkylaryl and arylalkyl; m is 5 to 100; and $Z=(C_uH_{2u}O)_r(C_vH_{2v}O)_sT$ wherein u and v=0 to 4 but at least one of u or v must be greater than 0, r+s=6 to 200,000; r=0 when u=0; s=0 when v=0; and T is selected from the group consisting of hydrogen, alkyl and benzyl.

10. The acid copper electroplating bath of claim 9 which further comprise a thioorganic compound represented by the formula:

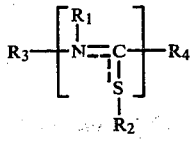

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one heteroatom selected from the group consisting of S, N and N-substituted atom, $R_3$ is selected from the group consisting of hydrogen alkyl and aralkyl, and $R_4$ is

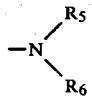

wherein $R_5$ and $R_6$ are each selected from the group consisting of hydrogen, alkyl and aralkyl groups.

11. The acid copper electroplating bath of claim 10 wherein said thioorganic compound is selected from the group consisting of thiourea, N-alkyl and aryl substituted thioureas, 2-thiazolidinethione, 1-(2-hydroxyethyl)-2-imidazolidine thione, 2-aminothiazole, 2-imidazoline thione, 2-mercaptopyridine and benzothiazolethione.

12. The acid copper bath of claim 9 wherein said polyalklyene imine is selected from the group consisting of ethylenediamine, propylene diamine, diethylene triamine and dipropylene triamine.

13. The acid copper electroplating bath of claim 9 wherein said epihalohydrin is epichlorohydrin.

14. The acid copper electroplating bath of claim 9 wherein said alkylated polyalkyleneimine is formed from substantially equimolar amounts of polyalkyleneimine and alkylating agent.

15. The acid copper electroplating bath of claim 9 wherein said organic sulfo sulfonate is a disulfo sulfonate represented by the formula:

$MO_3S(CH_2)_aS—S(CH_2)_aSO_3M$ wherein a is from 2 to 6.

16. The acid copper electroplating bath of claim 9 wherein said organic sulfo sulfonate is a sulfonated dialkyl dithiocarbamate represented by the formula:

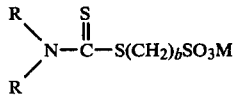

wherein R may be each an alkyl group of from 1 to 3 carbon atoms or a cycloaliphatic hydrocarbon and b is a number from 2 to 6.

17. The acid copper electroplating bath of claim 9 wherein said organic sulfo sulfonate is

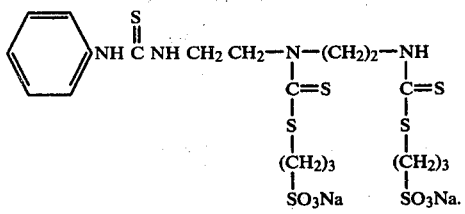

18. The acid copper electroplating bath of claim 9 wherein said organic sulfo sulfonate is:

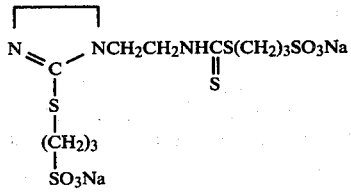

19. An aqueous acid copper electroplating bath containing:

a. An alkylated polyalkyleneimine obtained as the reaction product of a polyalkyleneimine represented by the formula:

$H_2N(CH_2)_nNH\ R$ wherein R is H or $(CH_2)_n\ NH_2$ and n=1 to 6 with an epihalohydrin and an alkylating agent;

b. An organic sulfo sulfonate represented by the formula:

$R_1—(S)_n—RSO_3M$ wherein M is an alkali metal or ammonium ion; n is from 1 to 6; R is selected from the group consisting of an alkylene group of from 1 to 8 carbon atoms, a divalent aromatic hydrocarbon and an aliphatic-aromatic hydrocarbon containing 6 to 12 carbon atoms; $R_1$ is selected from the group consisting of $MO_3SR$, wherein M & R are as described above,

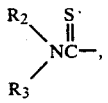

wherein $R_2$ & $R_3$ are each hydrogen or an alkyl group having from 1 to 4 carbon atoms,

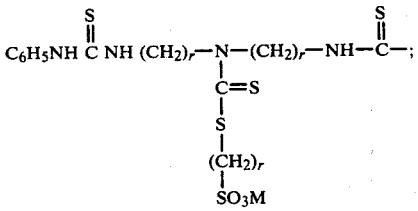

and

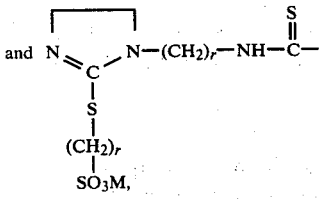

wherein r is from 2 to 6;

c. a polyether represented by the formula:

$R(OZ)_m$ wherein R is selected from the group consisting of hydrogen, alkyl, alkenyl, alkynyl, alkylaryl and arylalkyl; m is 5 to 100; and $Z=(C_uH_{2u}O)_r(C_vH_{2v}O)_sT$ wherein u and v=0 to 4 but at least one of u or v must be greater than 0, r+s=6 to 200,000; r=0 when u=0; s=0 when v=0; and T is selected from the group consisting of hydrogen, alkyl and benzyl and d. A thioorganic compound represented by the formula:

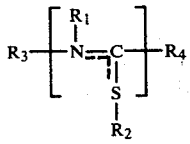

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one heteroatom selected from the group consisting of S, N and N-substituted atom, $R_3$ is selected from the group consisting of hydrogen alkyl and aralkyl, and $R_4$ is

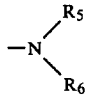

wherein $R_5$ and $R_6$ are each selected from the group consisting of hydrogen, alkyl and aralkyl groups.

20. The acid copper bath of claim 19 wherein said alkylating agent is selected from the group consisting of an alkyl halide having from 1 to 3 carbon atoms, an alkylene halide having from 3 to 6 carbon atoms, an alkynyl halide having from 3 to 6 carbon atoms and an aralkyl halide.

21. The acid copper bath of claim 20 wherein said aralkyl halide is benzyl chloride.

22. The acid copper electroplating bath of claim 19 wherein said epihalohydrin is epichlorohydrin.

23. The acid copper electroplating bath of claim 19 wherein said alkylated polyalkyleneimine is formed from substantially equimolar amounts of polyalkyleneimine and alkylating agent.

24. The acid copper electroplating bath of claim 19 wherein said organic sulfo sulfonate is a disulfosulfonate represented by the formula:

$MO_3S(CH_2)_aS—S(CH_2)_aSO_3M$ wherein a is from 2 to 6.

25. The acid copper electroplating bath of claim 19 wherein said organic sulfo sulfonate is a sulfonated dialkyl dithiocarbamate represented by the formula:

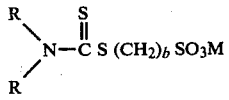

wherein R may be each an alkyl group of from 1 to 3 carbon atoms or a cycloaliphatic hydrocarbon and b is a number from 2 to 6.

26. The acid copper electroplating bath of claim 19 wherein said organic sulfo sulfonate is

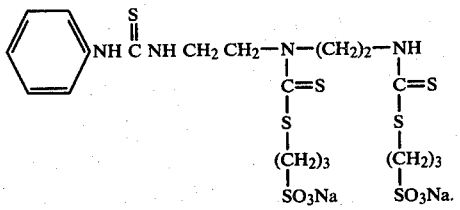

27. The acid copper electroplating bath of claim 19 wherein said organic sulfo sulfonate is:

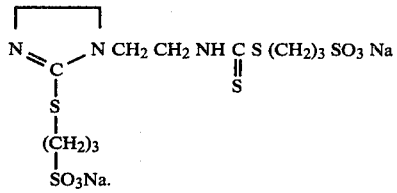

28. An aqueous acid copper electroplating bath containing:

a. An alkylated polyalkyleneimine obtained as the reaction product of a polyalkyleneimine represented by the formula:

$H_2N—(CH_2)_nNH—R$ wherein R is H or $(CH_2)_n NH_2$ and n=1 to 6, with epichlorohydrin and benzyl chloride, the molar amounts of polyalkyleneimine, epichlorohydrin and benzyl chloride being substantially equal;

b. an organic sulfo sulfonate represented by the formula:

$MO_3S(CH_2)_aS—S(CH_2)_aSO_3M$ wherein a is from 2 to 6;

c. a polyether represented by the formula:

$R(OZ)_m$ wherein R is selected from the group consisting of hydrogen, alkyl, alkenyl, alkynyl, alkylaryl and arylalkyl; m is 5 to 100; and $Z=(C_uH_{2u}O)_r(C_vH_{2v}O)_sT$ wherein u and v=0 to 4 but at least one of u or v must be greater than 0, r+s=6 to 200,000; r=0 when u=0; s=0 when v=0; and T is selected from the group consisting of hydrogen, alkyl and benzyl; and d. an equimolar combination of 2-thiazolidinethione and 1-(2-hydroxyethyl)-2-imidazolidinethione.

29. A process for producing copper deposits which comprises electrodepositing copper from an aqueous acidic copper bath containing the reaction product of a polyalkyleneimine represented by the formula:

$H_2N—(CH_2)_nNH—R$ wherein R is H or $(CH_2)_n NH_2$ and n=1 to 6 with an epihalohydrin and an alkylating agent.

30. The process of claim 29 in which said bath further comprises an organic sulfo sulfonate represented by the formula:

$R_1—(S)_n—RSO_3M$ wherein M is an alkali metal or ammonium ion; n is from 1 to 6; R is selected from the group consisting of an alkylene group having from 1 to 8 carbon atoms, a divalent aromatic hydrocarbon and an aliphatic-aromatic hydrocarbon containing 6 to 12 carbon atoms; $R_1$ is selected from the group consisting of $MO_3SR$, wherein M & R are as described above,

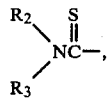

wherein $R_2$ & $R_3$ are each hydrogen or an alkyl group having from 1 to 4 carbon atoms,

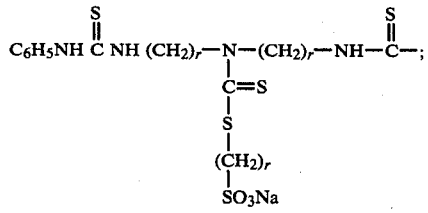

and

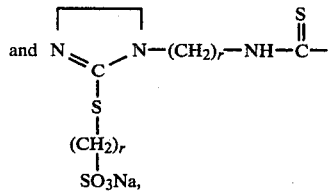

wherein r is from 2 to 6.

31. The process of claim 29 in which said bath further comprises a polyether represented by the formula:

$R(OZ)_m$ wherein R is selected from the group consisting of hydrogen, alkyl, alkenyl, alkynyl, alkylaryl and arylalkyl; m is 5 to 100; and $Z=(C_uH_{2u}O)_r(C_vH_{2v}O)_sT$ wherein u and v=0 to 4 but at least one of u or v must be greater than 0, r+s=6 to 200,000; r=0 when u=0; s=0 when v=0; and T is selected from the group consisting of hydrogen, alkyl and benzyl.

32. The process of claim 29 in which said bath further comprises a thioorganic compound represented by the formula:

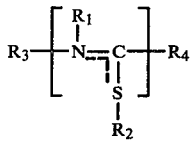

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one heteroatom selected from the group consisting of S, N and N-substituted atom, $R_3$ is selected from the group consisting of hydrogen, alkyl and aralkyl, and $R_4$ is

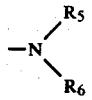

wherein $R_5$ and $R_6$ are each selected from the group consisting of hydrogen, alkyl and aralkyl groups.

33. A process for producing bright and leveled copper deposits which comprises electrodepositing copper from an aqueous acidic copper bath containing:

a. an alkylated polyalkyleneimine obtained as the reaction product of a polyalkyleneimine represented by the formula:

$$H_2N-(CH_2)_nNH-R$$

wherein R is H or $(CH_2)_n NH_2$ and n=1 to 6 with an epihalohydrin and an alkylating agent;

b. an organic sulfo sulfonate represented by the formula:

$$R_1-(S)_n-RSO_3M$$

wherein M is an alkali metal or ammonium ion; n is from 1 to 6; R is selected from the group consisting of an alkylene group of from 1 to 8 carbon atoms, a divalent aromatic hydrocarbon and an aliphatic-aromatic hydrocarbon containing 6 to 12 carbon atoms; $R_1$ is selected from the group consisting of $MO_3SR$, wherein M & R are as described above,

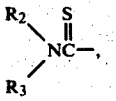

wherein $R_2$ & $R_3$ are each hydrogen or an alkyl group having from 1 to 4 carbon atoms,

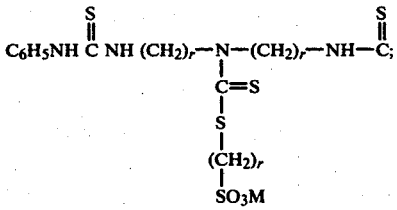

and

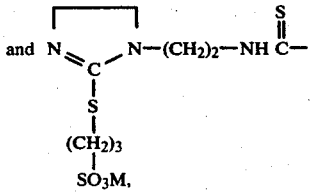

wherein r is from 2 to 6; and c. a polyether represented by the formula:

$$R(OZ)_m$$

wherein R is selected from the group consisting of hydrogen, alkyl, alkenyl, alkyryl, alkylaryl and arylalkyl; m is 5 to 100; and $$Z=(C_uH_{2u}O)_r(C_vH_{2v}O)_sT$$

wherein u and v=0 to 4 but at least one of u or v must be greater than 0, r+s=6 to 200,000; r=0 when u=0; s=0 when v=0; and T is selected from the group consisting of hydrogen, alkyl or benzyl.

34. The process of claim 33 wherein said bath which further comprises a thioorganic compound represented by the formula:

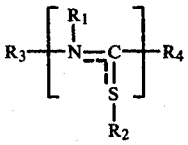

wherein the bond between C and S and N and C is a single or a double bond, $R_1$ or $R_2$ may be hydrogen or $R_1$ taken together with $R_2$ forms a heterocyclic ring structure of 5 to 6 members or a benzo-substituted heterocyclic ring structure of 5 to 6 members wherein said ring members are comprised totally of carbon atoms or carbon atoms and at least one heteroatom selected from the group consisting of S, N and N-substituted atom, $R_3$ is selected from the group consisting of hydrogen alkyl and aralkyl, and $R_4$ is

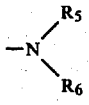

wherein $R_5$ and $R_6$ are each selected from the group consisting of hydrogen, alkyl and aralkyl groups.

35. The process of claim 34 wherein said organic sulfo sulfonate is a disulfo sulfonate represented by the formula:

$$MO_3S(CH_2)_aS-S(CH_2)_2SO_3M$$

wherein a is from 2 to 6.

36. The process of claim 34 wherein said organic sulfo sulfonate is a sulfonated dialkyl dithiocarbamate represented by the formula:

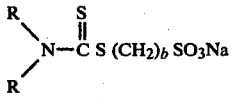

wherein R may be each an alkyl group of from 1 to 3 carbon atoms or a cycloaliphatic hydrocarbon and b is a number from 2 to 6.

37. The process of claim 34 wherein said organic sulfo sulfonate is

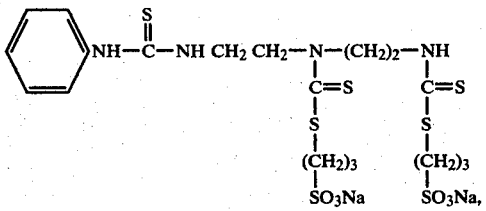

38. The process of claim 34 wherein said organic sulfo sulfonate is

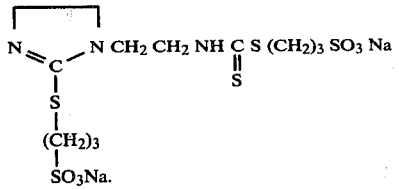

39. The process of claim 34 wherein said thioorganic compound is selected from the group consisting of thiourea, N-alkyl and aryl substituted thioureas, 2-thiazolidinethione, 1-(2-hydroxyethyl)-2-imidazolidinethione, 2-aminothiazole, 2-imidazolinethione, 2-mercaptopyridine, and benzothiazolethione.

40. The process of claim 33 wherein said organic sulfo sulfonate is a disulfo sulfonate represented by the formula:

$$MO_3S(CH_2)_aS—S(CH_2)_aSO_3M$$

wherein a is from 2 to 6.

41. The process of claim 33 wherein said organic sulfo sulfonate is as sulfonated dialkyl dithiocarbamate represented by the formula:

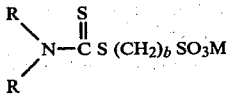

wherein R may be each an alkyl group of from 1 to 3 carbon atoms or a cycloaliphatic hydrocarbon and b is a number from 2 to 6.

42. The process of claim 33 wherein said organic sulfo sulfonate is

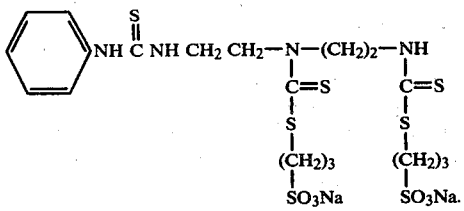

43. The process of claim 33 wherein said organic sulfo sulfonate is

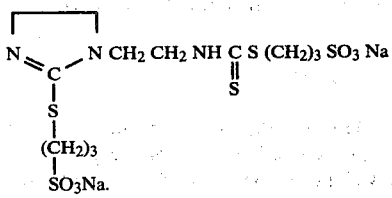

44. The process of claim 33 wherein said thioorganic compound is selected from the group consisting of thiourea, N-alkyl and aryl substituted thioureas, 2-thiazolidinethione, 1-(2-hydroxyethyl)-2-imidazolidinethione, 2-aminothiazole, 2-imidazolinethione, 2-mercaptopyridine, and benzothiazolethione.

45. The process of claim 33 wherein said bath further comprises a thioorganic compound which consists of an equimolar mixture of 2-thiazolidinethione and 1-(2-hydroxyethyl)-2-imidazolidine thione.

* * * * *